US005768217A

United States Patent [19]

Sonoda et al.

[11] Patent Number: 5,768,217

[45] Date of Patent: Jun. 16, 1998

[54] ANTENNAS AND THEIR MAKING METHODS AND ELECTRONIC DEVICES OR TIMEPIECES WITH THE ANTENNAS

[75] Inventors: Hiroyuki Sonoda, Ome; Shunji Minami, Fussa, both of Japan

[73] Assignee: Casio Computer Co., Ltd., Tokyo, Japan

[21] Appl. No.: 854,334

[22] Filed: May 12, 1997

[30] Foreign Application Priority Data

May 14, 1996 [JP] Japan ..... 8-119255

[51] Int. Cl.[6] ..... G04B 47/00; H01Q 1/12; H01Q 1/00

[52] U.S. Cl. ..... 368/10; 368/278; 368/296; 343/718; 343/720; 343/878; 343/904

[58] Field of Search ..... 368/10, 47, 88, 368/276, 278, 294–296; 343/713, 718, 720, 878, 904, 700 MS

[56] References Cited

U.S. PATENT DOCUMENTS 4,816,838 3/1989 Mizuno et al. ..... 343/771
4,992,801 2/1991 Saito et al. ..... 343/713
5,367,502 11/1994 Barroso et al. ..... 368/10
5,465,098 11/1995 Fujisawa et al. ..... 343/718
5,532,705 7/1996 Hama ..... 343/718
5,668,563 9/1997 Ogino et al. ..... 343/713

*Primary Examiner*—Vit W. Miska
*Attorney, Agent, or Firm*—Frishauf, Holtz, Goodman, Langer & Chick

[57] ABSTRACT

A thin antenna 20 having a satisfactory length, its making method, and an electronic device such as a wristwatch having such antenna. The antenna 20 is formed on a lower surface of a transparent plate 5 by printing an ornamental layer 22 on a lower surface of the transparent plate 5, forming a conductive ink layer 23 on the ornamental layer 22, and further forming plated metal layers 24, 25 on the conductive ink layer 23. Since the antenna 20 is thin as a whole, it may be provided within a small electronic device such as a wristwatch.

13 Claims, 4 Drawing Sheets

ANTENNAS AND THEIR MAKING METHODS AND ELECTRONIC DEVICES OR TIMEPIECES WITH THE ANTENNAS

BACKGROUND OF THE INVENTION

The present invention relates to antennas and their making methods and electronic devices or timepieces with such antennas.

It has been considered to provide an electronic device such as an electronic wristwatch with the functions of television, radio, and/or character broadcasts, and/or FM multibroadcast, and/or a pocket bell and/or GPS (Global Position System), and part of those functions has been put to practical use.

Radio wristwatches which receive time information sent by radio and synchronize themselves with the time information have been put to practical use in order to cause the wristwatches to perform its original time indication accurately.

Such wristwatch needs an antenna for receiving the sent radio waves. Thus, conventionally, either a flat portion of a wristband is used to dispose a loop antenna therein or a coil-like antenna is disposed within the wristwatch case.

With the wristwatch in which the antenna is disposed within the wristband, however, a sufficient length of antenna cannot be obtained because it is restricted by the length of the wristband. In addition, since the antenna is electrically connected to the inside of the watch case, a satisfactory waterproof structure cannot be provided.

On the other hand, with the watch in which the coil-like antenna is disposed within the case, its shape increases as the number of coil turns of the antenna increases, so that the wristwatch becomes large-sized and/or thicker, and difficult to handle as well as, the display area for information on time, etc., decreases as the antenna becomes large-sized, and the time information is difficult to read.

It is therefore an object of the present invention to provide an antenna whose satisfactory length is ensured to thereby decrease the thickness and size of an electronic device which contains such antenna, and a method of making such antenna.

It is another object of the present invention to provide an electronic device or timepiece which has a reduced thickness and size by disposing such antenna within the device or timepiece case.

SUMMARY OF THE INVENTION

In order to achieve the above objects, the present invention provides an antenna comprising:

a transparent plate, a conductive ink layer formed by printing on the transparent plate, and a metal layer plated on the conductive ink layer.

In this arrangement, the metal layer plated on the conductive ink layer functions to receive radio waves. By forming the metal layer in the form of a loop, the length of the loop becomes satisfactory. This antenna is composed of the printed conductive ink layer and the plated metal layer, so that the whole antenna is thin.

In this antenna, an ornamental layer of an opaque insulating ink may be printed between the transparent plate and the conductive ink layer for ornamenting purposes.

By this ornamental layer, the transparent plate becomes opaque, the conductive ink layer and the plated metal layer formed on the transparent plate cannot be viewed from outside to thereby improve the appearance of an electronic device or watch which includes the antenna.

The present invention provides an antenna making method comprising the steps of forming a conductive ink layer by printing on a transparent plate, and forming a metal layer by plating on the conductive ink layer.

The present invention provides another antenna making method comprising the steps of forming an ornamental layer of an opaque insulating ink by printing on a transparent plate, forming a conducting ink layer by printing on the ornamental layer, and forming a metal layer by plating on the conductive ink layer.

In those methods, the metal layer may be formed by chemical or electrolytic plating. Alternatively, the metal layer is formed by alternate chemical and electrolytic plating.

The metal layer, thus formed, has a function of receiving radio waves, so that it is formed as an antenna. By printing an ornamental layer, the transparent plate is rendered opaque.

The present invention also provides an electronic device comprising: a transparent plate disposed in an opening formed in a device case, an antenna comprising a conductive ink layer formed on the transparent plate and a metal layer plated on the conductive ink layer, and processing means disposed within the device case for processing a signal received by the antenna.

The antenna of this electronic device is formed by printing on the transparent plate, and has a satisfactory length and a reduced thickness. Therefore, the whole electronic device has a reduced thickness and size.

A display member may be disposed at a position facing the transparent plate within the device case and not overlapping with the antenna for displaying the signal processed by the processing means.

Since the display member displays a received signal, it is viewed easily. In this case, since the antenna itself is thin, the area and disposition of the display member are not limited and can be designed with a great degree of freedom.

The present invention also provides an electronic timepiece comprising a case having an opening therein, a transparent plate disposed in the opening in the case, an opaque insulating ink layer formed by printing along the periphery of a lower surface of the transparent plate, an antenna comprising a conducting ink layer formed on the insulating ink layer and a metal layer plated on the conducting ink layer, and processing means disposed within the case for processing a signal received by the antenna.

Since the antenna is formed as the layer on the transparent plate in this electronic timepiece, it is thin to thereby contribute to thinning of the case. Since the printed insulating ink layer renders the transparent plate opaque, the antenna formed on the transparent plate cannot be viewed from outside to thereby improve the appearance of the timepiece.

DESCRIPTION OF THE PREFERRED EMBODIMENTS

Figure 1:
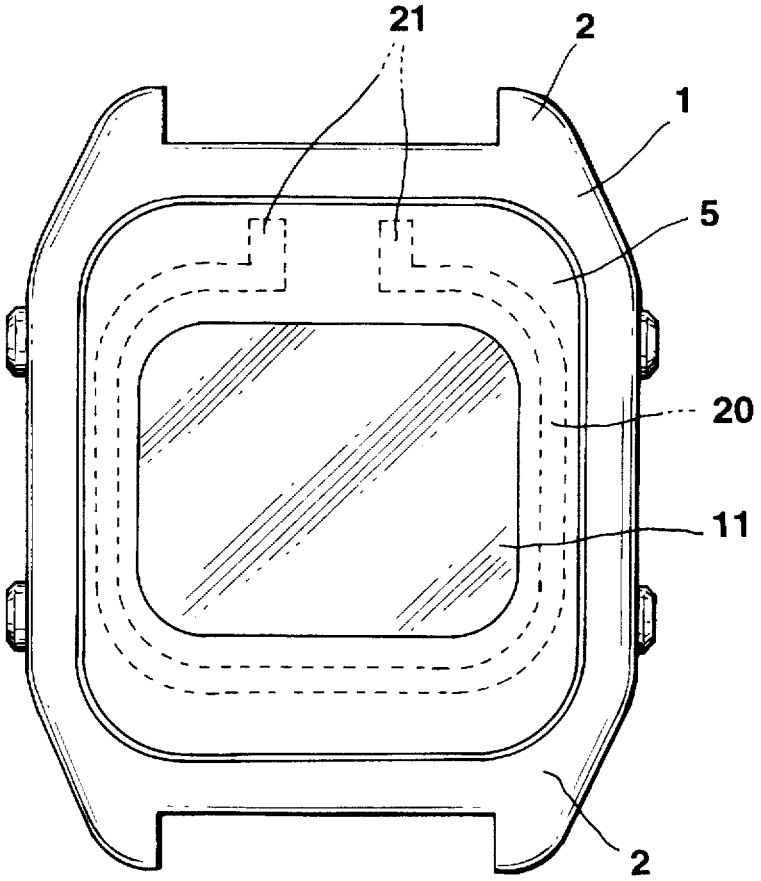
FIG. 1 is a plan view of an electronic wristwatch to which the present invention is applied.
Figure 2:
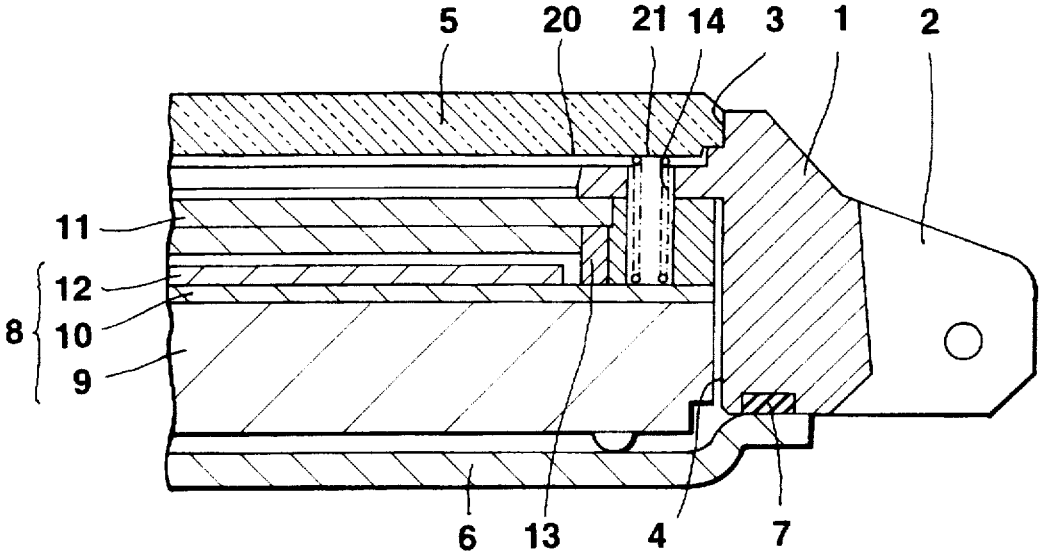
FIG. 2 is a fragmentary enlarged cross-sectional view of an essential portion of the electronic wristwatch of FIG. 1.

FIGS. 1 and 2 shows an embodiment of an electronic wristwatch to which the present invention is applied.

In FIGS. 1 and 2, band attachments 2 for attaching a wristband are provided at 6 and 12 o'clock to the wristwatch case, which has an upper opening 3 and a lower opening 4. Fitted in the upper opening 3 is a transparent plate 5 made of an acrylic or polycarbonate resin or glass whereas a back cover 6 covers the lower opening 4, so that the inside of the case 1 is sealed.

In FIG. 2, a seal ring 7 is provided between the back cover 6 and the case 1.

A wristwatch module 8 which fulfills the watch function is provided within the case 1. The module 8 is composed of a housing 9, and a circuit board 10 attached to the housing 9. An LSI 12 is attached to the circuit board and includes processing means for processing a signal received by an antenna 20 to be described later.

A liquid crystal display member 11 is disposed above the watch module 8. The display member 11 displays the signal processed by the LSI 12. The terminals of the display 11 are electrically connected to the circuit board 10 through an interconnector 13.

The display member 11 is disposed within the watch case 1 so as to face the transparent plate 5, so that the user can read the displayed information through the transparent plate 5.

In this electronic wristwatch, the antenna 20 is provided below the transparent plate 5. As shown in FIG. 1, the antenna 20 is provided in the form of a loop extending along the periphery of a lower surface of the transparent plate 5, so that a satisfactory length of the antenna is provided to thereby insure the receipt of a signal.

In FIG. 1, a terminal 21 of the antenna 20 is connected electrically to the circuit board 10. As shown in FIG. 2, such electrical connection is performed by providing a conductive coil spring 14 between the terminal 21 of the antenna and the circuit board 10. Thus, a signal received by the antenna 20 is inputted to the LSI 12, which then processes the received signal in a predetermined manner.

In this electronic wristwatch, the antenna 20 has a sufficient length in the form of a loop, the display area of the display member 11 is not limited by the antenna 20, and the display member 11 is disposed so as not to overlap with the antenna 20.

In this embodiment, the display member 11 is disposed inside the antenna 20 and fulfills its displaying function. By such arrangement, the display area is increased to facilitate the reading of the displayed information.

Figure 3:
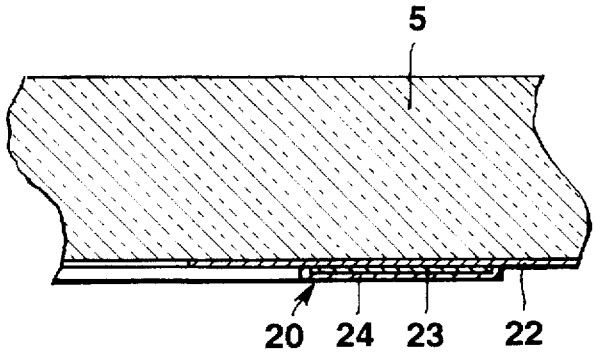
FIG. 3 is a cross-sectional view of an embodiment of an antenna.

FIG. 3 is a cross-sectional view of a portion of the wristwatch in which the antenna is formed. The antenna 20 is formed on an ornamental layer 22 printed with an opaque insulating ink on a lower surface of the transparent plate 5. The ornamental layer 22 shields the antenna 20 from the outside through the watch case 5. To this end, the ornamental layer 22 is formed in an area where the antenna 20 is formed or in an area between the outer periphery of the display member 11 and the outer periphery of the transparent plate 5 in FIG. 1.

Thereafter, a conductive ink layer 23 is formed by printing on the ornamental layer 22 area. The conductive ink is obtained by kneading a conductive pigment and a mixture of an adhesive and a solvent. The adhesive used is selected from among methacrylic acid ester resins such as an ABS resin, ethyl cellulose, and phenol resin. The solvent used is selected from among acetone, ethyl acetate, cellosolve derivatives, ketones, benzene, toluene, and ethylene chloride. The conductive pigment used is selected from among silver powder, silver oxide, silver nitrate, organic compounds of silver and copper powder.

The conductive ink layer 23 is provided so that the plated metal layer 23 adheres satisfactorily to the transparent plate 5. The conductive ink layer 23 is printed on the ornamental layer 22 so as to have the same shape as the antenna 20 of FIG. 1, and may be "DOTITE" (trademark; manufactured and sold by Fujikura Kasei Co., Ltd.).

The conductive ink layer 23 is chemically plated with a metal layer 24 of a conductive metal such as nickel or copper. Actually, the adhesive is etched away from the conductive ink layer 23 to make the surface of the ink layer 23 rough, the rough surface of the ink layer 23 is then chemically plated with a conductive metal such as nickel or copper in the presence of a catalyst such as platinum on the rough surface of the ink layer 23. In the etching, it is not preferable that the ornamental layer 22 is etched away with an etchant. Thus, the insulating ink for ornamental printing which has resistance to the etchant is preferably selected.

The conductive ink layer 23 and plated metal layer 24 thus formed function as the antenna 20 which receives radio waves.

As shown in FIG. 1, the antenna 20 takes the form of a loop, so that a sufficient length for the antenna is obtained. Thus, the wristwatch is capable of receiving time information sent by radio with the antenna 20 and processing the time information with processing means which includes the LSI 12 for automatic time synchronization.

Since the antenna 20 is formed by printing or plating, it is very thin. Thus, the electronic wristwatch is formed as a thin, small, lightweight one to thereby facilitate handling. In addition, since the antenna 20 is placed on the lower surface of the transparent plate 3, satisfactory waterproofness is ensured.

Figure 4:
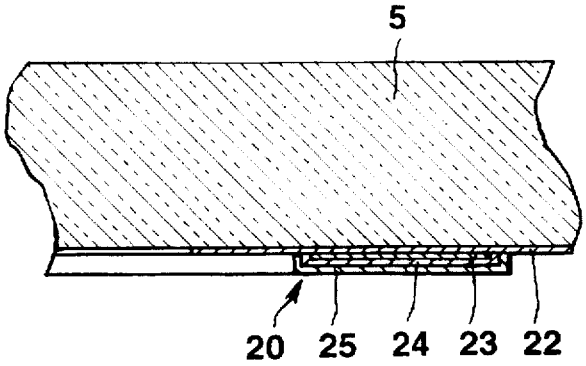
FIG. 4 is a cross-sectional view of another embodiment of the antenna.

FIG. 4 shows another embodiment of the antenna 20. The same reference numeral is used to identify similar elements of FIGS. 4 and 3. In this embodiment, an antenna 20 is composed of a conductive ink layer 23, a chemical plated layer 24 formed on the conductive ink layer 23, and an electrolytically plated layer 25 formed on the chemical plated layer 24. The chemically plated layer 23 is formed by chemically plating a conductive metal onto the conductive ink layer 23. The electrolytically plated layer 25 is formed by electrolytic plating on the chemically plated layer 24.

The electrolytic plating is carried away with a conductive metal such as nickel or copper, so that the electrolytically plated layer 25 is formed on the chemically plated layer 24. The electrolytic plating brings about a thick plated layer compared to the chemical plating, so that an antenna 20 of a conductive metal more in quantity than the antenna formed by the chemical plating is obtained. Thus, the sensitivity of the antenna 20 is improved for receipt of radio waves.

Figure 5:
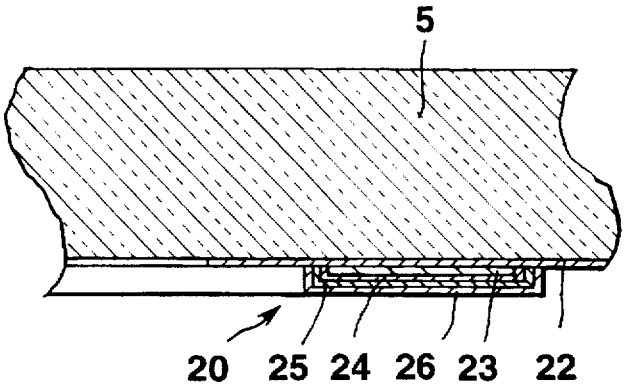
FIG. 5 is a cross-sectional view of a modification of the antenna of FIG. 4.

FIG. 5 shows a further electrolytically plated layer 26 of a conductive metal such as gold formed on the electrolytically plated layer 25 of the antenna 20 of FIG. 4. By using such multi-layered structure of electrolytically plated layers, the sensitivity of the antenna is further improved to thereby ensure receipt of radio waves. Especially when a noble metal such as gold, platinum or silver is used as a conductive metal for electrolytic plating, the electrical resistance is reduced to improve the sensitivity of the antenna.

Figure 6:
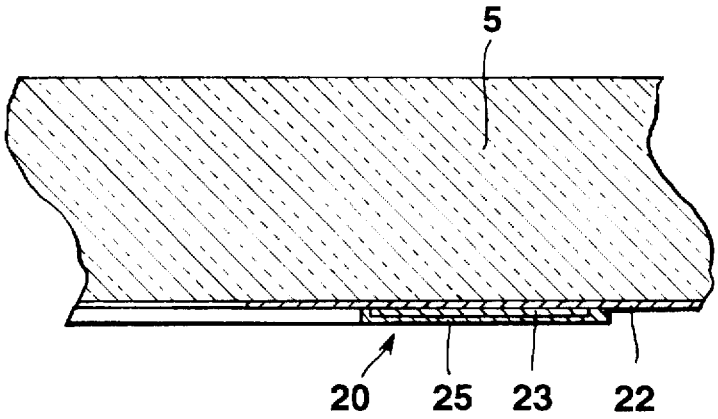
FIG. 6 is a cross-sectional view of still another embodiment of the antenna of FIG. 3.

FIG. 6 shows a further embodiment of the antenna 20, which is composed of a conductive ink layer 23 printed on an ornamental printed layer 22, and an electrolytically plated layer 25, for example, of nickel formed on the conductive ink layer 23. In this case, the electrolytic plating is directly carried out without carrying out chemical plating.

Figure 7:
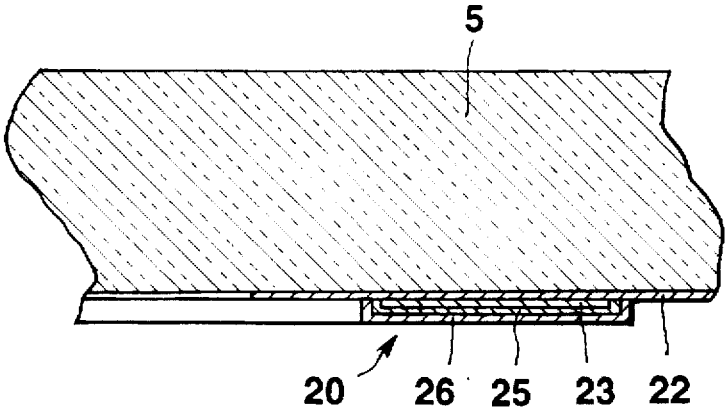
FIG. 7 is a cross-sectional view of a modification of the antenna of FIG. 6.

FIG. 7 shows a modification of the electronic wristwatch of FIG. 6, which contains a further electrolytically plated layer 26 formed on the underlying electrolytically plated layer 25. The overlying electrolytically plated layer 26 is composed of a noble metal such as gold to thereby reduce the electrical resistance of the antenna 20 to increase its sensitivity.

Figure 8:
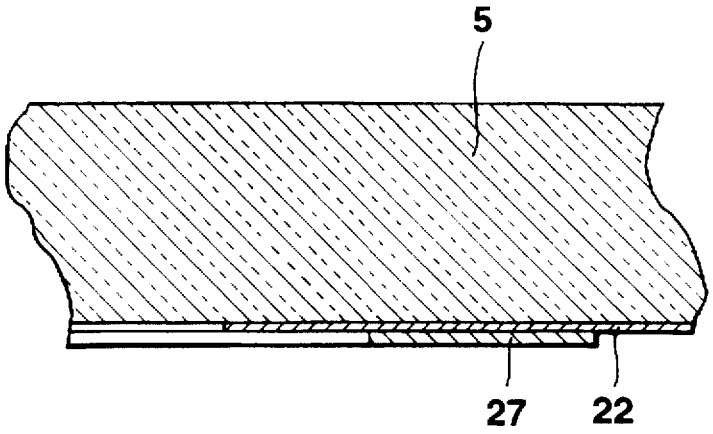
FIG. 8 is a cross-sectional view of a metal foil antenna.
Figure 9:
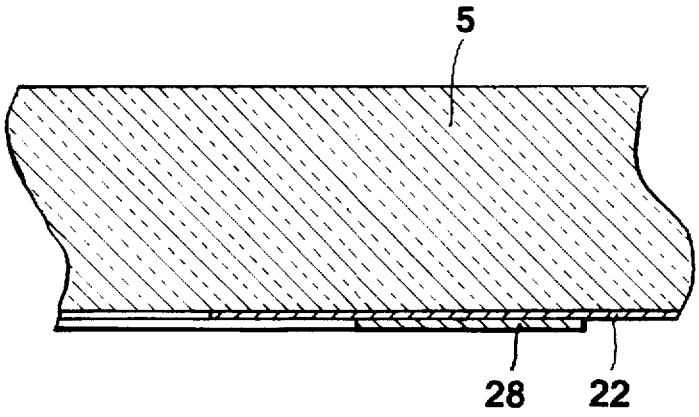
FIG. 9 is a cross-sectional view of an evaporated metal film antenna.
Figure 10:
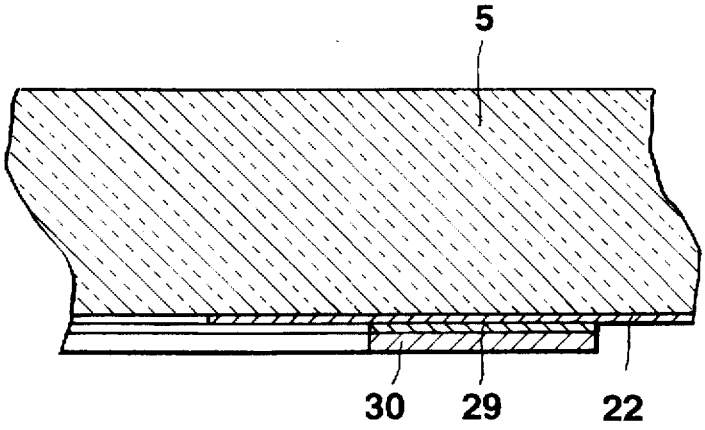
FIG. 10 is a cross-sectional view of an antenna having a conductive pattern.

FIGS. 8–10 show the structures of further antennas 20. The antenna 20 of FIG. 8 is composed of a loop-shaped metal foil 27 (FIG. 1), for example, of gold formed on an ornamental layer 22 which is printed on a transparent plate 5. The formation of the metal foil 27 is facilitated by coating the back of the metal foil with a hot-melt adhesive and by hot stamping.

An antenna 20 of FIG. 9 is composed of an evaporated metal layer 28 formed on an ornamental layer 22 which is printed on a transparent plate 5. The evaporated metal layer 28 may be composed of a conductive metal such as gold, nickel or copper. In the evaporation of such metal, a mask (not shown) may be used to form the loop-like antenna 20 of FIG. 1.

An antenna 20 of FIG. 10 is composed of a flexible conductive pattern 30 formed through an adhesive layer 29 on an ornamental layer 22 which is printed on a transparent plate 5 so as to function as an antenna for receipt of radio waves.

Although none of the antennas of FIGS. 8–10 are not formed by printing, any one of those antennas is thin, which contributes to reduction of the thickness, weight and size of the electronic wristwatch.

The invention is not limited to the above embodiments, and may be modified in various manners. For example, the invention is applicable to various electronic devices such as other timepieces, electronic notebooks, radio and television sets, FM multi-broadcasting receivers, pagers, GPS devices and others. A conductive ink layer may be formed directly on the transparent plate without forming an intermediate ornamental layer by printing.

Since the inventive antennas each are composed of a conductive ink layer printed on the transparent plate, and a metal layer plated on the conductive ink layer, they are thin and each ensure a length sufficient for its function.

According to the inventive antenna making methods, antennas are made easily and securely. Since the inventive electronic device or timepiece has a thin internal antenna therein, it is thin and small as a whole and ensures receipt of signals.

What is claimed is:

1. an antenna comprising:

a transparent plate;

a conductive ink layer formed by printing on said transparent plate; and a metal layer plated on said conductive ink layer.

2. The antenna according to claim 1, further comprising:

an ornamental layer of an opaque insulating ink printed between said transparent plate and said conductive ink layer for ornamenting purposes.

3. The antenna according to claim 1, wherein said metal layer is formed by alternate chemical and electrolytic plating.

4. An antenna making method comprising the steps of:

forming a conductive ink layer by printing on a transparent plate; and forming a metal layer by plating on said conductive ink layer.

5. The antenna according to claim 4, wherein said metal layer is formed by alternate chemical and electrolytic plating.

6. An antenna making method comprising the steps of:

forming an ornamental layer of an opaque insulating ink by printing on a transparent plate;

forming a conducting ink layer by printing on said ornamental layer; and forming a metal layer by plating on said conductive ink layer.

7. The antenna making method according to claim 6, wherein said metal layer is formed by chemical or electrolytic plating.

8. The antenna making method according to claim 6, wherein said metal layer is formed by alternate chemical and electrolytic plating.

9. An electronic device comprising:

a transparent plate disposed in an opening formed in a device case;

an antenna comprising a conductive ink layer formed on said transparent plate and a metal layer plated on the conductive ink layer; and processing means disposed within the device case for processing a signal received by the antenna.

10. The electronic device according to claim 9, wherein said metal layer is formed by alternate chemical and electrolytic plating.

11. The electronic device according to claim 9, comprising a display member disposed at a position facing said transparent plate within the device case and not overlapping with said antenna for displaying the signal processed by said processing means.

12. An electronic timepiece comprising:

a case having an opening therein;

a transparent plate disposed in the opening in said case;

an opaque insulating ink layer formed by printing along the periphery of a lower surface of said transparent plate;

an antenna comprising a conducting ink layer formed on said insulating ink layer and a metal layer plated on said conducting ink layer; and processing means disposed within said case for processing a signal received by said antenna.

13. The electronic device according to claim 12, wherein said metal layer is formed by alternate chemical and electrolytic plating.

* * * * *